US006453149B1

(12) United States Patent
Dobbertin et al.

(10) Patent No.: US 6,453,149 B1
(45) Date of Patent: Sep. 17, 2002

(54) SYSTEM AND METHOD FOR REGISTERING LONG RECEIVERS

(75) Inventors: Michael T. Dobbertin, Honeoye; John A. Winterberger, Spencerport, both of NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/699,195

(22) Filed: Oct. 27, 2000

(51) Int. Cl.[7] ..... G03G 15/00
(52) U.S. Cl. ..... 399/388; 399/389; 399/396
(58) Field of Search ..... 399/381, 388, 399/389, 394, 395, 396; 271/226, 227, 228, 250, 252, 253, 254, 255, 270, 272

(56) References Cited

U.S. PATENT DOCUMENTS 5,094,442 A 3/1992 Kamprath et al. ..... 271/227
5,322,273 A 6/1994 Rapkin et al. ..... 271/227
5,678,127 A * 10/1997 Suga ..... 399/389 X
5,731,680 A 3/1998 Winterberger et al. ..... 318/685

* cited by examiner

*Primary Examiner*—Sophia S. Chen
*Assistant Examiner*—Hoan Tran

(57) ABSTRACT

An apparatus and method for moving a receiver having a lead edge and a trailing edge from an upstream engaging nip into registered relationship with an image-bearing member moving at an image-bearing member speed. A motor, a drive member operable to engage the receiver, and a drive coupling connecting the motor with the drive member are provided. A controller drives the motor in accordance with a velocity profile if the receiver is of a predetermined optimal receiver length, and drives the motor in accordance with a second velocity profile if the receiver is longer than the predetermined optimal receiver length.

25 Claims, 7 Drawing Sheets

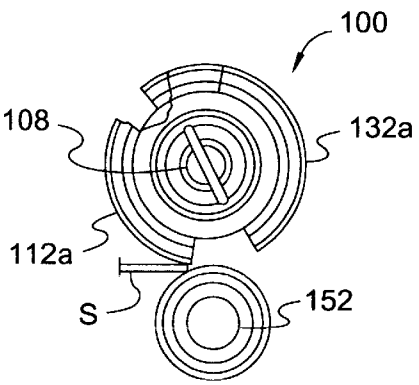
FIG. 7a
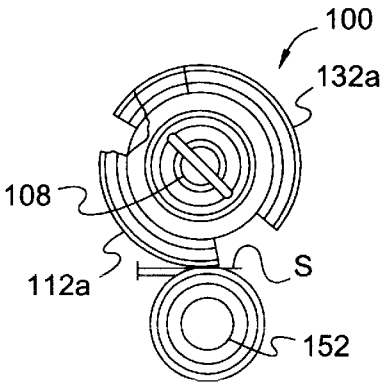
FIG. 7b
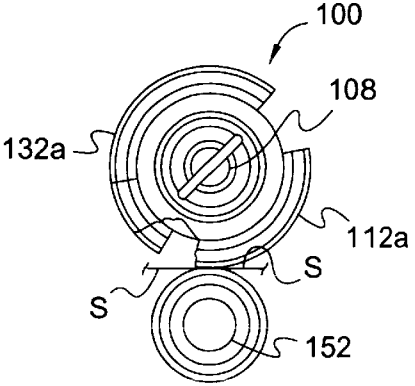
FIG. 7c
FIG. 7d
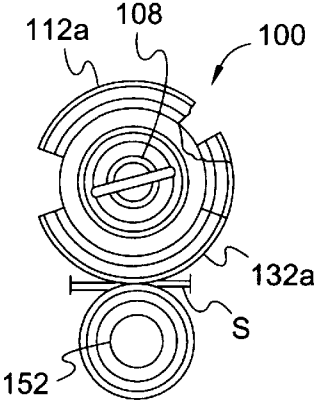
FIG. 7e
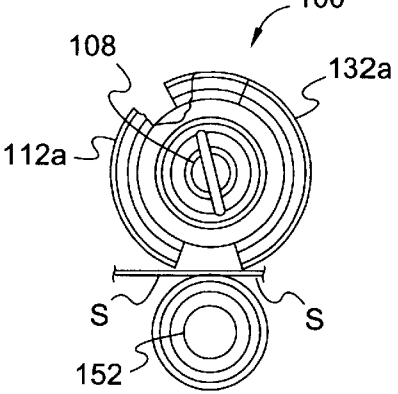
FIG. 7f

SYSTEM AND METHOD FOR REGISTERING LONG RECEIVERS

BACKGROUND OF THE INVENTION

1. Field of the Invention

This invention relates to electrophotographic reproduction apparatus and methods for registering sheets and more particularly to apparatus and methods for control of a stepper motor drive for controlling movement of a receiver sheet into transfer relationship with an image-bearing member that supports an image to be transferred to the receiver sheet.

2. Brief Description of Available Systems

In known electrophotographic copier, printers or duplicators the problem of accurate registration of a receiver sheet with a moving member supporting an image for transfer to the sheet is well known. In this regard, reference is made to U.S. Pat. No. 5,322,273, the contents of which are incorporated herein by reference.

Typically, an electrophotographic latent image is formed on the member and this image is toned and then transferred to a receiver sheet directly or transferred to an intermediate image-bearing member and then to the receiver sheet. In moving of the receiver sheet into transfer relationship with the image-bearing member, it is important to adjust the sheet for skew. Once the skew of the sheet is corrected, it is advanced by rollers driven by stepper motors towards the image-bearing member. During the skew control adjustment, the adjustment is implemented by selectively driving the stepper motor driven rollers, which are controlled independently of movement of the image-bearing member. Typically, movement of the receiver sheet and operations performed thereon by various stations are controlled using one or more encoders. Known registration control systems use a transfer roller with which an encoder wheel is associated. This encoder is used for controlling registration of the sheet. For instance, a registration apparatus is disclosed in U.S. Pat. No. 5,731,680, the contents of which are incorporated herein by reference.

However, previous registration apparatus and methods have been limited in that they can only process and register receiver sheets that are no longer than a predetermined maximum length. Typically, the hardware of known systems has been optimized to accommodate the most popular sheet sizes, such as those having lengths of 8.5 inches or 17 inches. These registration systems have been unable to accommodate and register receiver sheets that are longer than this predetermined optimal receiver length. For example, systems optimized for 17-inch sheets have been unable to accommodate 18-inch sheets. Although there is an increasing need for accommodation of 18-inch receiver sheets in electrophotographic reproduction apparatus, the vast majority of demand is still for accommodation of receiver sheets having lengths of 17 inches or less. It is, therefore, an object of the invention to provide improved methods and apparatus for ensuring accurate registration of receiver sheets that are somewhat longer than the predetermined optimal receiver length for which specific registration assembly hardware is designed.

BRIEF SUMMARY OF THE PREFERRED EMBODIMENTS

In accordance with one aspect of the invention, there is provided an apparatus for moving a receiver having a lead edge and a trailing edge from an upstream engaging nip into registered relationship with an image-bearing member moving at an image-bearing member speed. The apparatus includes a motor, a drive member operable to engage the receiver, and a drive coupling connecting the motor with the drive member. A controller is provided to drive the motor in accordance with a first velocity profile if the receiver is of a predetermined optimal receiver length, and to drive the motor in accordance with a second velocity profile if the receiver is longer than the predetermined optimal receiver length.

In accordance with another aspect of the invention, there is provided an apparatus for moving a receiver having a lead edge, a trailing edge, and a length of more than the predetermined optimal receiver length, from an upstream engaging nip into registered relationship with an image-bearing member moving at an image-bearing member speed. The apparatus includes a motor, a drive member operable to engage the receiver, and a drive coupling connecting the motor with the drive member. A sensor is included to detect the lead edge of the receiver. A controller drives a motor to (1) move the drive member into engagement with the receiver when the lead edge of the receiver has moved a distance beyond the sensor, the distance being sufficiently large that the trailing edge of the receiver is released from the nip before the receiver is brought to a stop; (2) stop the receiver; and (3) deliver the receiver to the image-bearing member at the proper time and at a speed substantially equal to the image-bearing member speed.

In accordance with yet another aspect of the invention, there is provided a method of moving a receiver having a lead edge and a trailing edge from an upstream engaging nip into registered relationship with a moving image-bearing member moving at an image-bearing member speed. First, a motor, a drive member operable to engage the motor, and a drive coupling connecting the motor with the drive member are provided. The a controller is provided to drive the motor. The controller is operated in accordance with a first velocity profile if the receiver is of the predetermined optimal receiver length, and the controller is operated in accordance with a second velocity profile if the receiver is longer than the predetermined optimal receiver length.

In accordance with a further aspect of the invention, there is provided a method of moving a receiver having a lead edge, a trailing edge, and a length of more than the predetermined optimal receiver length, from an upstream engaging nip into registered relationship with a moving image-bearing member moving at an image-bearing member speed. First, the lead edge of the receiver is detected. A drive member is then moved into engagement with the receiver when the lead edge has moved a distance beyond the sensor, the distance being sufficiently large that the trailing edge of the receiver is released from the nip before the receiver is brought to a stop. Next, the receiver is stopped. The receiver is then delivered to the image-bearing member at the proper time and at a speed substantially equal to the image-bearing member speed.

The invention and its various advantages will become more apparent to those skilled in the art from the ensuing detailed description of preferred embodiments, reference being made to the accompanying drawings.

BRIEF DESCRIPTION OF THE DRAWINGS

The subsequent description of the preferred embodiments of the present invention refers to the attached drawings, wherein:

FIGS. 7*a*–7*f* are respective side elevational views of the urging rollers of the sheet registration mechanism of FIG. 1 at various time intervals in the operation of the sheet registration mechanism;

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1:
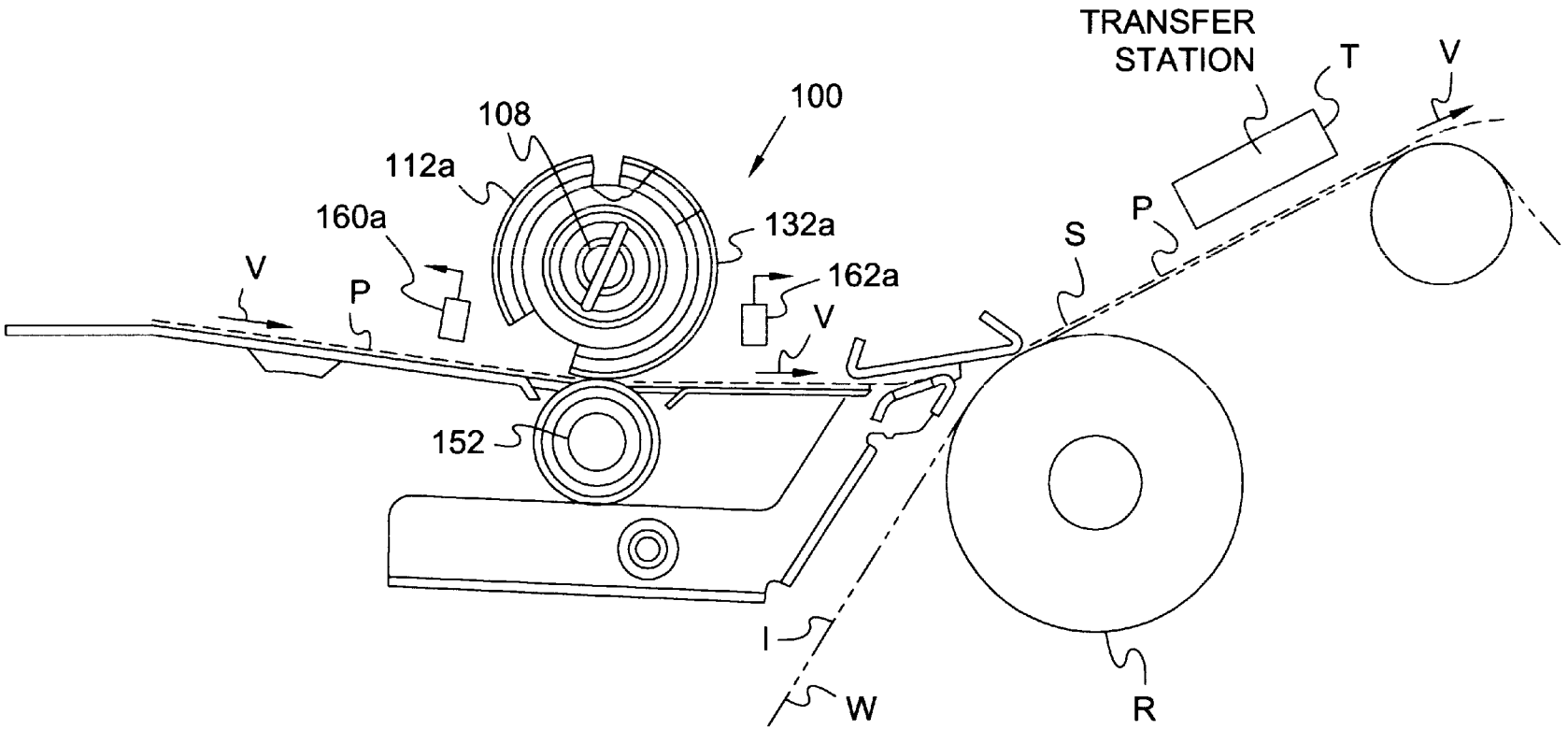
FIG. 1 is a side elevational view of a sheet registration mechanism, partly in cross-section, and with portions removed to facilitate viewing.
Figure 2:
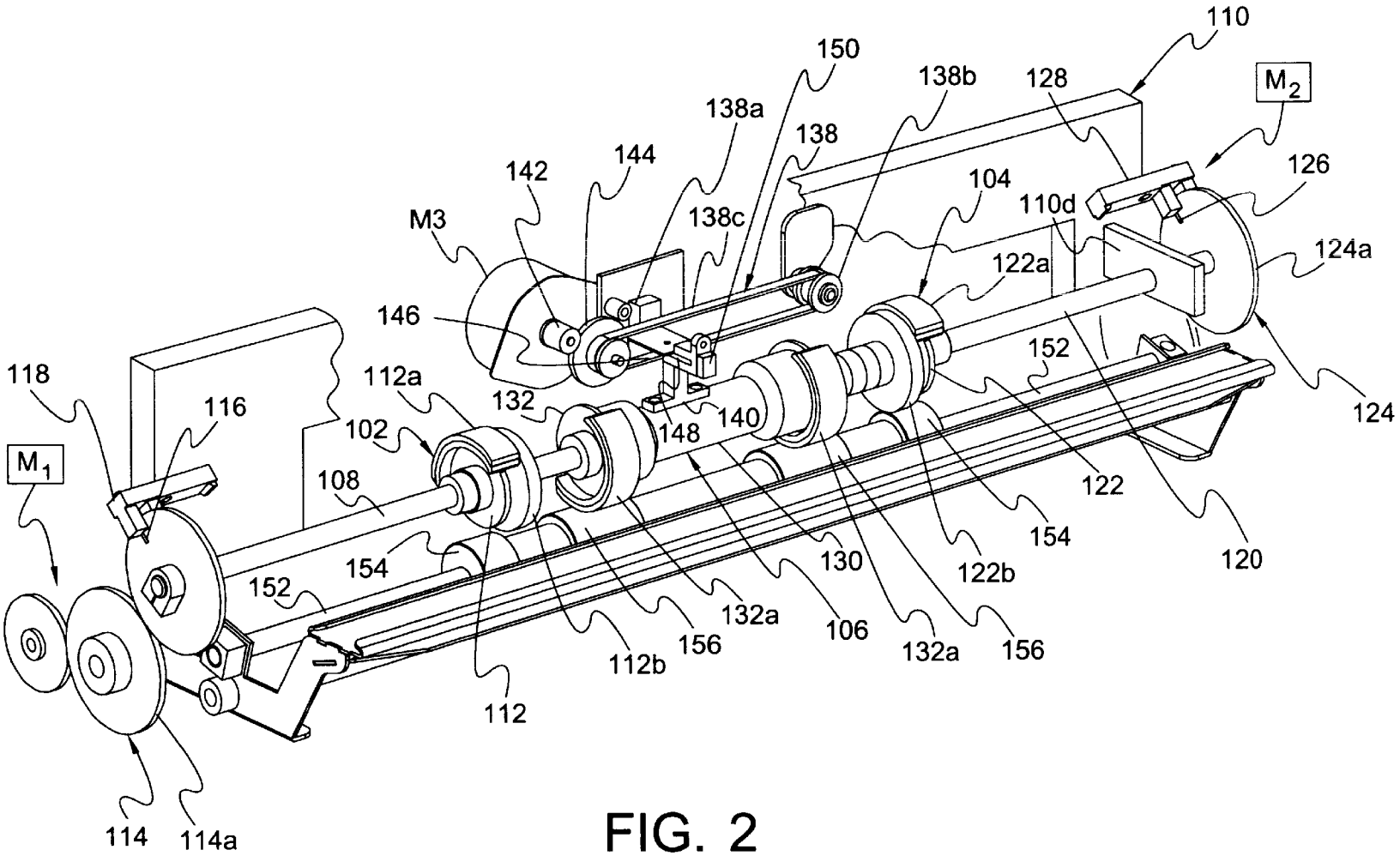
FIG. 2 is a view, in perspective, of the sheet registration mechanism of FIG. 1, with portions removed or broken away to facilitate viewing.
Figure 3:
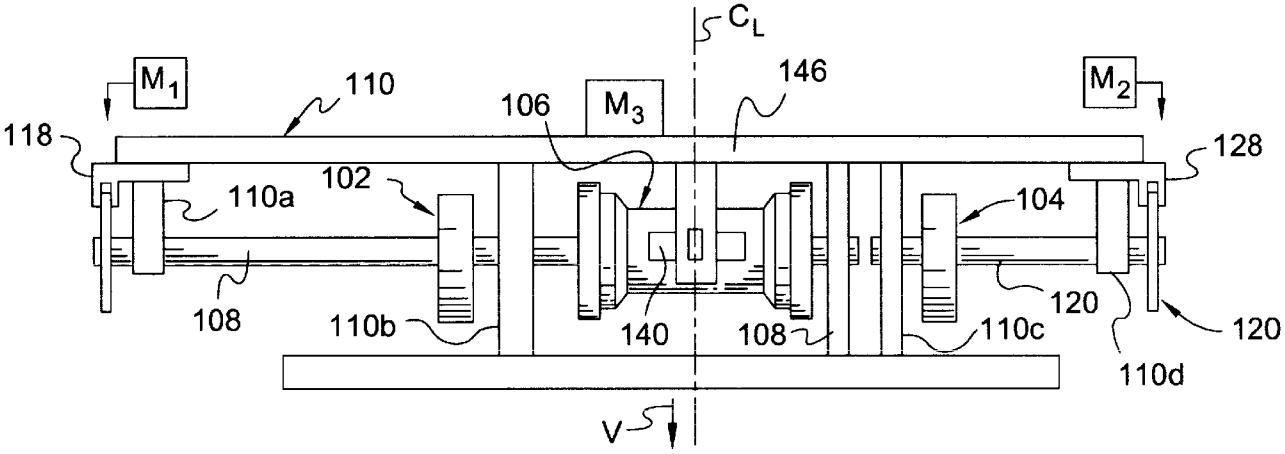
FIG. 3 is a top plan view of the sheet registration mechanism of FIG. 1, with portions removed or broken away to facilitate viewing.

Referring now to the accompanying drawings, FIGS. 1–3 best show the sheet registration mechanism, designated generally by the numeral 100, according to this invention. The sheet registration mechanism 100 is located in association with a substantially planar sheet transport path P of any well known device where sheets are transported seriatim from a supply (not shown) to a station where an operation is performed on the respective sheets. For example, the device may be a reproduction apparatus, such as a copier or printer or the like, where marking particle developed images of original information, are placed on receiver sheets. As shown in FIG. 1, the marking particle developed images (e.g., image I) are transferred at a transfer station T from an image-bearing member such as a movable web or drum (e.g., web W) to a sheet of receiver material (e.g., a cut sheet S of plain paper or transparency material) moving along the path P. A transfer roller R guides the web W.

In reproduction apparatus of the above type, it is desired that the sheet S be properly registered with respect to a marking particle developed image in order for the image to be placed on the sheet in an orientation to form a suitable reproduction for user acceptability. Accordingly, the sheet registration mechanism 100 provides for alignment of the receiver sheet in a plurality of orthogonal directions. That is, the sheet is aligned, with the marking particle developed image, by the sheet registration mechanism by removing any skew in the sheet (angular deviation relative to the image), and moving the sheet in a cross-track direction so that the centerline of the sheet in the direction of sheet travel and the centerline of the marking particle image are coincident. Further, the sheet registration mechanism 100 times the advancement of the sheet along the path P such that the sheet and the marking particle image are aligned in the in-track direction as the sheet travels through the transfer station T. In order to accomplish skew correction and cross-track and in-track alignment of the receiver with respect to the image-bearing member, a drive member is operable to engage the receiver. For example, to register the sheet S with respect to a marking particle developed image on the moving web W, the sheet registration apparatus 100 according to this invention includes first and second independently driven roller assemblies 102, 104, and a third roller assembly 106. The first roller assembly 102 includes a first shaft 108 supported adjacent its ends in bearings 110*a*, 110*b* mounted on a frame 110. Support for the first shaft 108 is selected such that the first shaft is located with its longitudinal axis lying in a plane parallel to the plane through the sheet transport path P and substantially perpendicular to the direction of a sheet traveling along the transport path in the direction of arrows V (FIG. 1). A first urging drive roller 112 is mounted on the first shaft 108 for rotation therewith. The urging roller 112 has an arcuate peripheral segment 112*a* extending about 180° around such roller. The peripheral segment 112*a* has a radius to its surface measured from the longitudinal axis of the first shaft 108 substantially equal to the minimum distance of such longitudinal axis from the plane of the transport path P.

A motor is operable to drive the drive member via a drive coupling. For instance, a first stepper motor $M_1$, mounted on the frame 110, is operatively coupled to the first shaft 108 through a gear train 114 to rotate the first shaft when the motor is activated. The gear 114*a* of the gear train 114 incorporates an indicia 116 detectable by a suitable sensor mechanism 118. The sensor mechanism 118 can be either optical or mechanical depending upon the selected indicia. Location of the sensor mechanism 118 is selected such that when the indicia 116 is detected, the first shaft 108 will be angularly oriented to position the first urging roller 112 in a home position. The home position of the first urging roller is that angular orientation where the surface of the arcuate peripheral segment 112*a* of the roller 112, upon further rotation of the shaft 108, will contact a sheet in the transport path P (see FIG. 7*a*).

The second roller assembly 104 includes a second shaft 120 supported adjacent its ends in bearings 110*c*, 110*d* mounted on the frame 110. Support of the second shaft 120 is selected such that the second shaft is located with its longitudinal axis lying in a plane parallel to the plane through the sheet transport path P and substantially perpendicular to the direction of a sheet traveling along the transport path. Further, the longitudinal axis of the second shaft 120 is substantially coaxial with the longitudinal axis of the first shaft 108.

A second urging drive roller 122 is mounted on the second shaft 120 for rotation therewith. The urging roller 122 has an arcuate peripheral segment 122*a* extending about 180° around such roller. The peripheral segment 122*a* has a radius to its surface measured from the longitudinal axis of the first shaft 108 substantially equal to the minimum distance of such longitudinal axis from the plane of the transport path P. The arcuate peripheral segment 122*a* is angularly coincident with the arcuate peripheral segment 112*a* of the urging roller 112. A second independent stepper motor $M_2$, mounted on the frame 110, is operatively coupled to the second shaft 120 through a gear train 124 to rotate the second shaft when the motor is activated. The gear 124*a* of the gear train 124 incorporates an indicia 126 detectable by a suitable sensor mechanism 128. The sensor mechanism 128, adjustably mounted on the frame 110, can be either optical or mechanical depending upon the selected indicia. Location of the sensor mechanism 128 is selected such that when the indicia 126 is detected, the second shaft 120 will be angularly oriented to position the second urging roller 122 in a home position. The home position of the second urging roller is that angular orientation where the surface of the arcuate peripheral segment 122*a* of the roller 122, upon further rotation of the shaft 120, will contact a sheet in the transport path P (same as the angular orientation of the peripheral segment 112*a* as shown in FIG. 7*a*).

Figure 4:
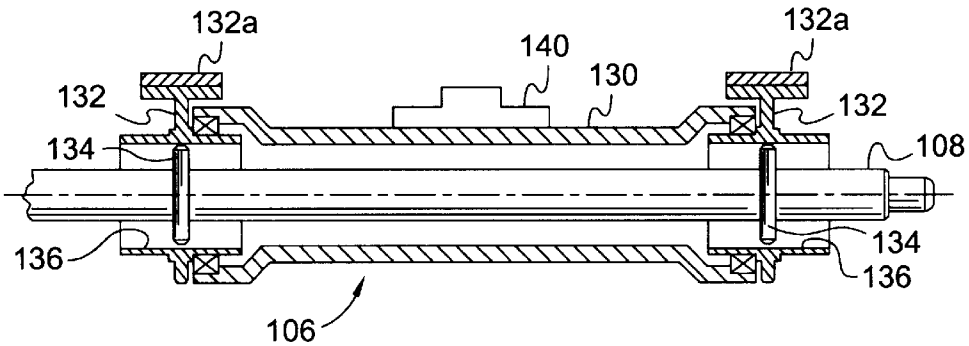
FIG. 4 is a front elevational view, in cross-section of the third roller assembly of the sheet registration mechanism of FIG. 1.

The third roller assembly 106 includes a tube 130 surrounding the first shaft 108 and capable of movement relative to the first shaft in the direction of the longitudinal axis thereof. A pair of third urging drive rollers 132 are mounted on the first shaft 108, supporting the tube 130 for relative rotation with respect to the third urging rollers. The third urging rollers 132 respectively have an arcuate peripheral segment 132*a* extending about 180° around each roller. The peripheral segments 132*a* each have a radius to its respective surface measured from the longitudinal axis of the first shaft 108 substantially equal to the minimum distance of such longitudinal axis from the plane of the transport path P. The arcuate peripheral segments 132*a* are angularly offset with respect to the arcuate peripheral segments 112*a,* 122*a* of the first and second urging rollers. The pair of third urging rollers 132 are coupled to the first shaft 108 by a key or pin 134 engaging a slot 136 in the respective rollers (FIG. 4). Accordingly, the third urging rollers 132 will be rotatably driven with the first shaft 108 when the first shaft is rotated by the first stepper motor $M_1$, and are movable in the direction along the longitudinal axis of the first shaft with the tube 130. For the purpose to be more fully explained below, the angular orientation of the third urging rollers 132 is such that the arcuate peripheral segments 132*a* thereof are offset relative to the arcuate peripheral segments 112*a* and 122*a*.

A third independent stepper motor $M_3$, mounted on the frame 110, is operatively coupled to the tube 130 of the third roller assembly 106 to selectively move the third roller assembly in either direction along the longitudinal axis of the first shaft 108 when the motor is activated. The operative coupling between the third stepper motor $M_3$ and the tube 130 is accomplished through a pulley and belt arrangement 138. The pulley and belt arrangement 138 includes a pair of pulleys 138*a,* 138*b,* rotatably mounted in fixed spatial relation, for example, to a portion of the frame 110. A drive belt 138*c* entrained about the pulleys is connected to a bracket 140 which is in turn connected to the tube 130. A drive shaft 142 of the third stepper motor $M_3$ is drivingly engaged with a gear 144 coaxially coupled to the pulley 138*a*. When the stepper motor $M_3$ is activated, the gear 144 is rotated to rotate the pulley 138*a* to move the belt 138*c* about its closed loop path. Depending upon the direction of rotation of the drive shaft 142, the bracket 140 (and thus the third roller assembly 106) is selectively moved in either direction along the longitudinal axis of the first shaft 108.

A plate 146 connected to the frame 110 incorporates an indicia 148 detectable by a suitable sensor mechanism 150. The sensor mechanism 150, adjustably mounted on the bracket 140, can be either optical or mechanical depending upon the selected indicia. Location of the sensor mechanism 150 is selected such that when the indicia 148 is detected, the third roller assembly 106 is located in a home position. The home position of the third roller assembly 106 is selected such that the third roller assembly is substantially centrally located relative to the cross-track direction of a sheet in the transport path P. The frame 110 of the sheet registration mechanism 100 also supports a shaft 152 located generally below the plane of the sheet transport path P. Pairs of idler rollers 154 and 156 are mounted on the shaft 152 for free rotation. The rollers of the idler pair 154 are respectively aligned with the first urging roller 112 and the second urging roller 122. The rollers of the idler roller pair 156 are aligned with the respective third urging rollers 132, and extend in a longitudinal direction for a distance sufficient to accommodate for maintaining such alignment over the range of longitudinal movement of the third roller assembly 106. The spacing of the shaft 152 from the plane of the sheet transport path P and the diameter of the respective rollers of the idler roller pairs 154 and 156 are selected such that the rollers will respectively form a nip relation with the arcuate peripheral segments 112*a,* 122*a,* and 132*a* of the urging rollers. For example, the shaft 152 may be spring loaded in a direction urging such shaft toward the shafts 108, 120, where the idler roller pair 154 will engage spacer roller bearings 112*b,* 122*b*.

With the above described construction for the sheet registration mechanism 100 according to this invention, sheets traveling seriatim along the sheet transport path P are alignable by removing any skew (angular deviation) in the sheet to square the sheet up with respect to the path, and moving the sheet in a cross-track direction so that the centerline of the sheet in the direction of sheet travel and the centerline $C_L$ of the transport path P are coincident. Of course, the centerline $C_L$ is arranged to be coincident with the centerline of the downstream operation station (in the illustrated embodiment, the centerline of a marking particle image on the web W). Further, the sheet registration mechanism 100 times the advancement of the sheet along the transport path P for alignment in the in-track direction (again referring to the illustrated embodiment, in register with the lead edge of a marking particle image on the web W).

In order to effect the desired skew removal, and cross-track and in-track sheet alignment, the mechanical elements of the sheet registration mechanism 100 according to this invention are operatively associated with a controller. Appropriate controllers and control systems are described in U.S. Pat. No. 5,731,680 and co-pending U.S. patent application Ser. No. 09/698,512, SYSTEM AND METHOD FOR IMPROVED REGISTRATION PERFORMANCE, the contents of which are incorporated herein by reference. The controller receives input signals from a plurality of sensors associated with the sheet registration mechanism 100 and a downstream operation station. Based on such signals and an operating program, the controller produces appropriate signals to control the independent stepper motors $M_1$, $M_2$, and $M_3$ of the sheet registration mechanism.

For the operation of the sheet registration mechanism 100, referring now particularly to FIGS. 5, 6 and 7*a*–7*f,* a sheet S traveling along the transport path P is moved into the vicinity of the sheet registration mechanism by an upstream transport assembly including non-separable nip rollers (not shown). Such sheet may be oriented at an angle (e.g., angle $\alpha$ in FIG. 5) to the centerline $C_L$ of the path P and may have its center A spaced a distance from the path centerline (e.g., distance d in FIG. 5). The angle $\alpha$ and distance d, which are undesirable, are of course generally induced by the nature of the upstream transport assembly and are variable sheet-to-sheet.

Figure 5:
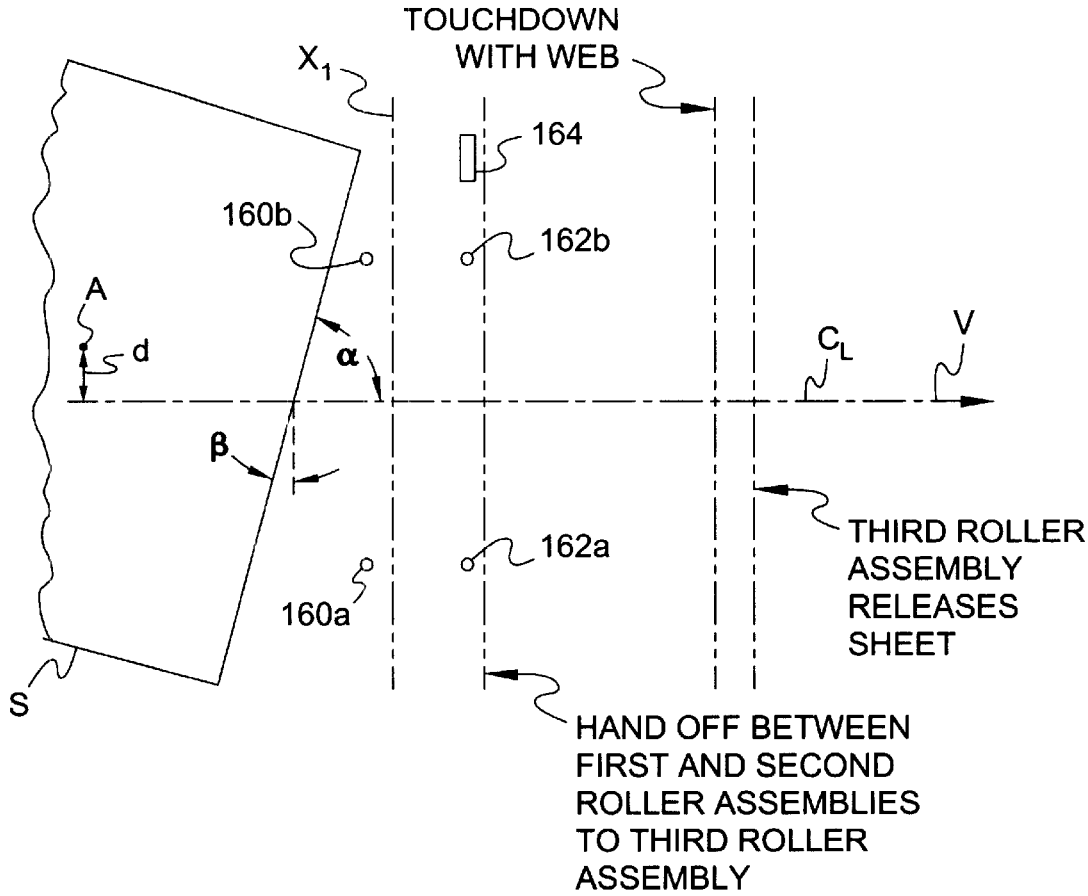
FIG. 5 is top schematic illustration of the sheet transport path showing the actions of the sheet registration mechanism of FIG. 1 on an individual sheet as it is transported along a transport path.

A pair of nip sensors 160*a,* 160*b* is located upstream of the plane $X_1$ (see FIG. 5). The plane $X_1$ is defined as including the longitudinal axes of the urging rollers (112, 122, 132) and the rollers of the idler roller pairs (154, 156).

The nip sensors 160*a*, 160*b* may, for example, be of either the optical or mechanical type. Nip sensor 160a is located to one side (in the cross-track direction) of the centerline $C_L$, while nip sensor 160*b* is located a substantially equal distance to the opposite side of the centerline $C_L$.

When the sensor 160*a* detects the lead edge of a sheet transported along the path P, it produces a signal which is sent to the controller for the purpose of activating the first stepper motor $M_1$. In a like manner, when the sensor 160*b* detects the lead edge of a sheet transported along the path P, it produces a signal which is sent to the controller for the purpose of activating the second stepper motor $M_2$. If the sheet S is at all skewed relative to the path P, the lead edge to one side of the centerline $C_L$ will be detected prior to detection of the lead edge at the opposite side of the centerline (of course, with no skew, the lead edge detection at opposite sides of the centerline will occur substantially simultaneously).

Figure 6:
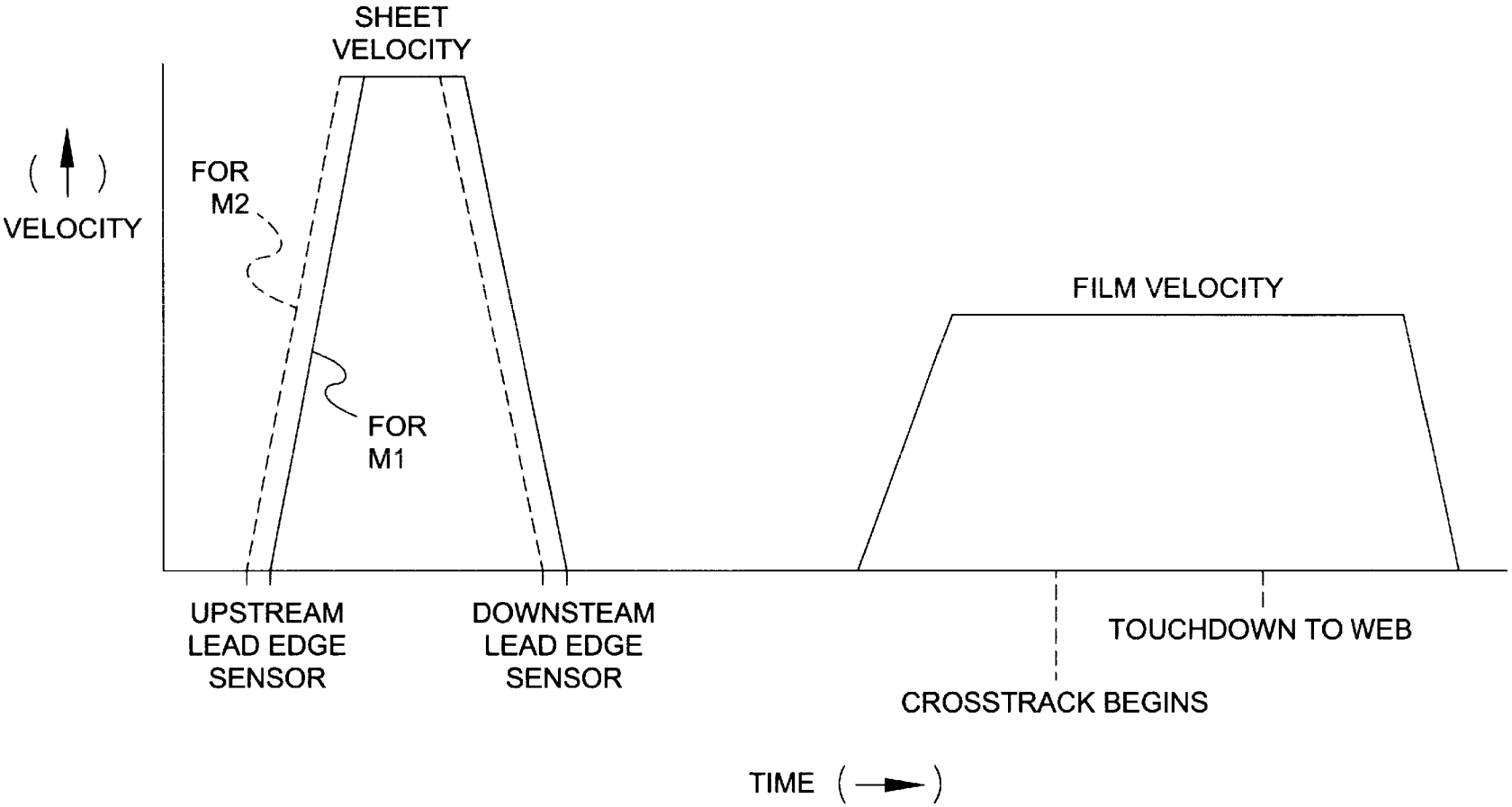
FIG. 6 is a graphical representation of the peripheral velocity profile over time for the urging rollers of the sheet registration mechanism of FIG. 1.

As shown in FIG. 6, when the first stepper motor $M_1$ is activated by the controller, it will ramp up to a speed such that the first urging roller 112 will be rotated at an angular velocity to yield a predetermined peripheral speed for the arcuate peripheral segment 112*a* of such roller substantially equal to the entrance speed of a sheet transported along the path P. When the portion of the sheet S enters the nip between the arcuate peripheral segment 112*a* of the first urging roller 112 and the associated roller of the idler roller pair 154, such sheet portion will continue to be transported along the path P in a substantially uninterrupted manner (see FIG. 7*b*).

Likewise, when the second stepper motor $M_2$ is activated by the controller, it will ramp up to a speed such that the second urging roller 122 will be rotated at an angular velocity (substantially the same as the angular velocity of the first urging roller) to yield a predetermined peripheral speed for the arcuate peripheral segment 122*a* of such roller substantially equal to the speed of a sheet transported along the path P. When the portion of the sheet S enters the nip between the arcuate peripheral segment 122*a* of the second urging roller 122 and the associated roller of the idler roller pair 154, such sheet portion will continue to be transported along the path P in a substantially uninterrupted manner. As seen in FIG. 5, due to the angle a of the sheet S, sensor 160*b* will detect the sheet lead edge prior to the detection of the lead edge by the sensor 160*a*. Accordingly, the stepper motor $M_2$ will be activated prior to activation of the motor $M_1$.

A pair of in-track sensors 162*a*, 162*b* is located downstream of the plane $X_1$. As such, the in-track sensors 162*a*, 162*b* are located downstream of the nips formed respectively by the arcuate peripheral segments 112*a*, 122*a* and their associated rollers of the idler roller pairs 154. Thus, the sheet S will be under the control of such nips. The in-track sensors 162*a*, 162*b* may, for example, be of either the optical or mechanical type. Sensor 162*a* is located to one side (in the cross-track direction) of the centerline $C_L$, while sensor 162*b* is located a substantially equal distance to the opposite side of the centerline $C_L$.

When the sensor 162*a* detects the lead edge of a sheet transported along the path P by the urging roller 112, it produces a signal which is sent to the controller for the purpose of deactivating the first stepper motor $M_1$. In a like manner, when the sensor 162*b* detects the lead edge of a sheet transported along the path P by the urging roller 122, it produces a signal which is sent to the controller for the purpose of deactivating the second stepper motor $M_2$. Again, if the sheet S is at all skewed relative to the path P, the lead edge at one side of the centerline $C_L$ will be detected prior to detection of the lead edge at the opposite side of the centerline.

When the first stepper motor $M_1$ is deactivated by the controller 22, its speed will ramp down to a stop such that the first urging roller 112 will have zero angular velocity to stop the engaged portion of the sheet in the nip between the arcuate peripheral segment 112*a* of the first urging roller 112 and the associated roller of the idler roller pair 154 (see FIG. 7*c*). Likewise, when the second stepper motor $M_2$ is deactivated by the controller, its speed will ramp down to a stop such that the first urging roller 112 will have zero angular velocity to stop the engaged portion of the sheet in the nip between the arcuate peripheral segment 122*a* of the second urging roller 122 and the associated roller of the idler roller pair 154. Again referring to FIG. 5, due to the angle $\alpha$ of the sheet S, sensor 162*b* will detect the sheet lead edge prior to the detection of the lead edge by the sensor 162*a*. Accordingly, the stepper motor $M_2$ will be deactivated prior to deactivation of the motor $M_1$. Therefore, the portion of the sheet in the nip between the arcuate peripheral segment 122*a* of the second urging roller 122 and the associated roller of the idler roller pair 154 will be held substantially fast (i.e., will not be moved in the direction along the transport path P) while the portion of the sheet in the nip between the arcuate peripheral segment 112*a* of the first urging roller 112 and the associated roller of the idler roller pair 154 continues to be driven in the forward direction. As a result, the sheet S will rotate substantially about its center A until the motor $M_1$ is deactivated. Such rotation, through an angle $\beta$ substantially complementary to the angle $\alpha$) will square up the sheet and remove the skew in the sheet relative to the transport path P to properly align the lead edge thereof.

Once the skew has been removed from the sheet, as set forth in the above description of the first portion of the operative cycle of the sheet registration mechanism 100, the sheet is ready for subsequent cross-track alignment and registered transport to a downstream location. A sensor 164, such as a set of sensors (either optical or mechanical as noted above with reference to other sensors of the registration mechanism 100) aligned in the cross-track direction (see FIG. 5), detects a lateral marginal edge of the sheet S and produces a signal indicative of the location thereof.

The signal from the sensor 164 is sent to the controller where the operating program will determine the distance (e.g., distance d shown in FIG. 5) of the center A of the sheet from the centerline $C_L$ of the transport path P. At an appropriate time determined by the operating program, the first stepper motor $M_1$ and the second stepper motor $M_2$ will be activated. The first urging roller 112 and the second urging roller 122 will then begin rotation to start the transport of the sheet toward the downstream direction (see FIG. 7*d*). The stepper motors will ramp up to a speed such that the urging rollers of the roller assemblies 102, 104, and 106 will be rotated at an angular velocity to yield a predetermined peripheral speed for the respective portions of the arcuate peripheral segments thereof. Such predetermined peripheral speed is, for example, substantially equal to the speed of the web W. While other predetermined peripheral speeds are suitable, it is important that such speed be substantially equal to the speed of the web W when the sheet S touches down at the web.

Of course, in view of the above coupling arrangement for the third roller assembly 106, rotation of the third urging rollers 132 will also begin when the first stepper motor $M_1$ is activated. As will be appreciated from FIGS. 7*a*–7*d,* up to this point in the operative cycle of the sheet registration mechanism 100, the arcuate peripheral segments 132*a* of the third urging rollers 132 are out of contact with the sheet S and have no effect thereon. Now the arcuate peripheral segments 132*a* engage the sheet (in the nip between the arcuate peripheral segments 132*a* and the associated rollers of the idler roller pair 156) and, after a degree of angular rotation, the arcuate peripheral segments 112*a* and 122*a* of the respective first and second urging rollers leave contact with the sheet (see FIG. 7*e*). The control over the sheet is thus handed off from the nips established by the arcuate peripheral segments of the first and second urging rollers and the idler roller pair 154 to the arcuate peripheral segments of the third urging rollers and the idler roller pair 156 such that the sheet is under control of only the third urging rollers 132 for transport of the sheet along the path P.

At a predetermined time, once the sheet is solely under the control of the third urging rollers 132, the controller activates the third stepper motor $M_3$. Based on the signal received from sensor 164 and the operating program of the controller, the stepper motor $M_3$ will drive the third roller assembly 106, through the above-described belt and pulley arrangement 138, in an appropriate direction and for an appropriate distance in the cross-track direction. Accordingly, the sheet in the nips between the arcuate peripheral segments of the third urging rollers 132 and the associated rollers of the idler roller pair 156 is urged in a cross-track direction to a location where the center A of the sheet coincides with the centerline $C_L$ of the transport path P to provide for the desired cross-track alignment of the sheet.

The third urging rollers 132 continue to transport the sheet along the transport path P at a speed substantially equal to the speed of the web W until the lead edge touches down on the web, in register with the image I carried by the web. At this point in time, the angular rotation of the third urging rollers 132 brings the arcuate peripheral segments 132*a* of such rollers out of contact with the sheet S (see FIG. 7*f*). Since the arcuate peripheral segments 112*a* and 122*a* of the respective first and second urging rollers 112 and 122 are also out of contact with the sheet, such sheet is free to track with the web W undisturbed by any forces which might otherwise have been imparted to the sheet by any of the urging rollers.

At the time the first, second and third urging rollers are all out of contact with the sheet, the stepper motors $M_1$, $M_2$, and $M_3$ are activated for a time, dependent upon signals to the controller from the respective sensors 118, 128, and 150, and then deactivated. As described above, such sensors are home position sensors. Accordingly, when the stepper motors are deactivated, the first, second, and third urging rollers are respectively located in their home positions. Therefore, the roller assemblies 102, 104, 106 of the sheet registration mechanism 100 according to this invention are located as shown in FIG. 7*a,* and the sheet registration mechanism is ready to provide skew correction and cross-track and in-track alignment for the next sheet transported along the path P.

As noted above, known registration systems are limited in that they can process only sheets no longer than a predetermined optimal receiver length. For instance, the distance between the non-separable nips of the upstream transport assembly and the registration roller assemblies of these systems may be optimized for processing of 17-inch or shorter sheets. In particular, this distance is such that the trailing edge of a 17-inch sheet is released from the upstream nips a short time before the sheet is brought to a stop for skew correction in the registration mechanism. The upstream nips drive the sheet until it is engaged by the roller assemblies of the registration mechanism. Thus, these nips must be sufficiently close to the registration mechanism such that they continue to engage and drive the sheet until the sheet is engaged by the registration mechanism. Accordingly, a longer sheet, such as an 18-inch sheet, may not be processed in the normal manner because its trailing edge would still be engaged by the upstream nips when its lead edge is brought to a stop during registration. As a result, proper registration may not be achieved. The sheet may even buckle and cause the registration mechanism to jam.

One solution to this problem is to modify the upstream nips to make them separable. After the registration mechanism has engaged a longer sheet, the upstream nips could be separated, thus releasing the sheet before it is stopped in the registration process. However, this hardware modification is non-ideal because it requires the upstream nips to separate on a per-sheet basis for all sheets longer than 17 inches. The present invention provides a modification in the registration control procedures that allows for processing of longer sheets without modification to the hardware of the upstream transport assembly. The modification is made to the registration velocity profiles that control timing of the registration process.

Figure 8:
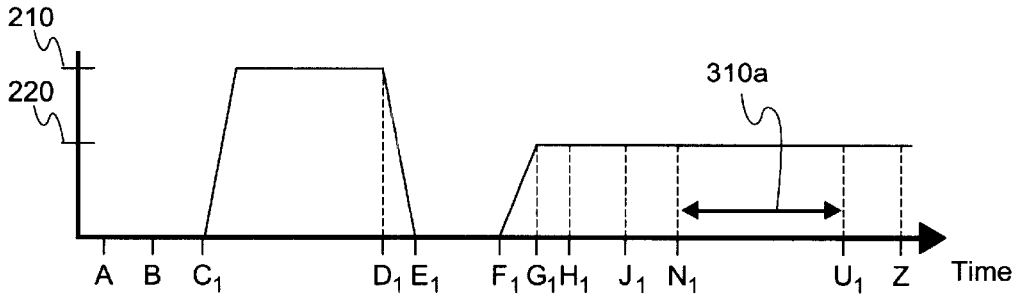
FIG. 8 is a timing diagram of a normal registration velocity profile according to known registration systems.

A timeline of a normal velocity profile is shown in FIG. 8. The timeline shows the circumferential velocity of the first and second arcuate peripheral segments 112*a,* 122*a* of the first and second drive rollers 112, 122 as they engage the receiver sheet S and move it through the registration process. The process begins at time A when the registration mechanism receives a reference signal (F-PERF) indicating that the image I is at a predetermined reference location relative to the sheet touch down point. At time B, the lead edge of the receiver sheet S is detected by the nip sensors 160*a,* 160*b*. At this time, drive rollers 112, 122 are in their home positions as described above (see FIG. 7*a*). At time $C_1$, the drive rollers 112, 122 ramp up in speed such that the peripheral segments 112*a,* 122*a* engage the receiver sheet S at entrance speed 210. Entrance speed 210 is a relatively high speed at which the receiver sheet S is moved toward the in-track sensors 162*a,* 162*b*. For instance, entrance speed may be approximately 32.5 inches/second. At time $D_1$, the sheet is detected by the in-track sensors 162*a,* 162*b*. At this time, a ramp-down of the sheet speed is initiated. To correct for skew of the receiver sheet S, ramp-down for the two drive rollers 112, 122 may be initiated independently, as described above. At time $E_1$, when both drive rollers have completed ramp-down, the receiver sheet S will be properly oriented, and the skew will have been corrected. The sheet S is thus stopped at a predetermined optimal stopping position. For instance, the optimal stopping position may be one in which the lead edge of the sheet S is positioned approximately 2.539 inches beyond the nip sensors 160*a,* 160*b*.

After time $E_1$, the receiver sheet dwells for a period before ramping up to web speed 220 at time $F_1$. Web speed 220 is the speed at which the receiver sheet S is delivered to the moving web W. Web speed is approximately equal to the speed at which the web W moves. For instance, web speed may be approximately 17.68 inches/second. At time $G_1$, when the receiver sheet S achieves web speed 220, the first and second peripheral segments 112*a,* 122*a* are still in engagement with the sheet S. The third peripheral segments 132*a* have not yet engaged the sheet S. As the first and second shafts 108, 120 continue to rotate, the third peripheral segments engage the sheet S at time $H_1$, and the first and second peripheral segments 112*a,* 122*a* release the sheet S at time $J_1$ (as shown in FIGS. 7*c–e*). After the first and second peripheral segments 112*a,* 122*a* have released the sheet S, drive of the sheet S is controlled solely by the peripheral segments 132*a* of the third rollers 132 for a period of time. Cross-track registration occurs during the period 310*a* of time between time $N_1$ and time $U_1$, while the sheet S is controlled by the third peripheral segment 132*a*. This period 310*a* of time may, for example, be approximately 50 milliseconds. At the proper time Z, the receiver sheet S touches down on the moving web W.

The velocity profile described above provides accurate registration of receiver sheets that have lengths no longer than the predetermined optimal receiver length. According to the present invention, modified velocity profiles are provided for registering longer sheets. For instance, a first modified velocity profile for registering 18-inch sheets in a system optimized for 17-inch sheets is discussed with reference to the timeline of FIG. 9.

In this first modified velocity profile, the lead edge of the 18-inch receiver sheet is detected by the nip sensors 160*a,* 160*b* at time B. This time B is the same as the time B at which the lead edge of a sheet S is detected in the normal velocity profile (FIG. 8). However, the drive rollers 112, 122 are maintained in their home positions for an incremental period of time before ramp-up is initiated at time $C_2$. The incremental period of time may be, for example, approximately 16 milliseconds. Accordingly, the 18-inch sheet, which is being driven by the upstream nips, travels an incremental distance before it is engaged by the peripheral segments 112*a,* 122*a* of the first and second drive rollers 112, 122. The incremental distance must be sufficient to allow the upstream nips to release the trailing edge of the 18-inch sheet before the sheet is ramped down for skew correction. For example, the incremental distance may be approximately 0.520 inches. For this same reason, the ramp-down is not initiated immediately after the lead edge of the 18-inch sheet is detected by the in-track sensors 162*a,* 162*b* at time $D_{2a}$. Instead, the ramp-down is initiated at time $D_{2b}$, which occurs an incremental period of time after in-track detection. This incremental period of time is preferably the same as the incremental period of additional time before ramp-up at time $C_2$. Again, for example, this period of time may be approximately 16 milliseconds.

At time $E_2$, the 18-inch sheet is brought to a stop. Any skew in the sheet has been corrected. However, the lead edge of the 18-inch sheet is positioned an incremental distance beyond the predetermined optimal stopping position. This incremental distance is preferably the same as the incremental distance discussed above and may be, for example, approximately 0.520 inches. To ensure that the 18-inch sheet touches down on the moving web W at the proper time Z, the sheet is allowed to dwell for an extended period of time before being ramped up to web speed 220 at time $F_2$. The 18-inch sheet achieves web speed 220 at time $G_2$. As the drive shafts 108, 120 continue to rotate, the third peripheral segments 132*a* engage the sheet at time $H_2$, and the first and second peripheral segments 112*a,* 122*a* release the sheet at time $J_2$. The 18-inch sheet is then in the control of the third peripheral segments 132*a,* enabling cross-track registration to occur between time $N_2$ and time $U_2$. The 18-inch sheet then touches down on the moving web W at the proper time Z.

Figure 9:
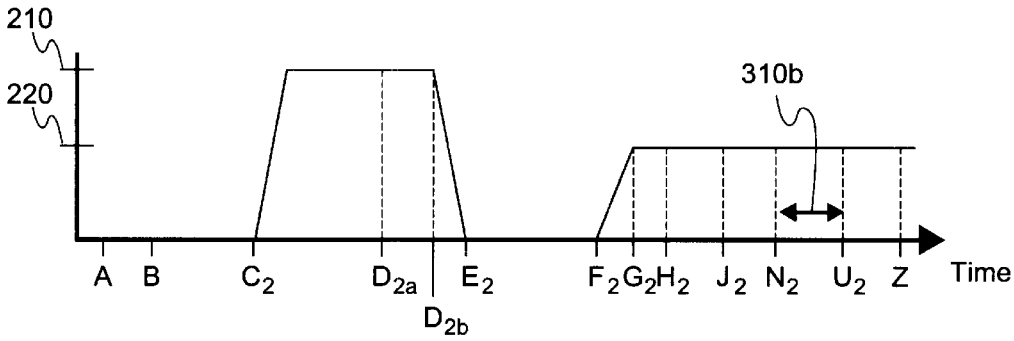
FIG. 9 is a timing diagram of a registration velocity profile for processing long receiver sheets according to one presently preferred embodiment of the invention.

As a result of the extended dwell period of the first modified velocity profile, the period 310*b* of time available for cross-track registration is shortened. For example, this period 310*b* of time may be approximately 20 milliseconds compared with the 50 millisecond period 310*a* of the normal profile (FIG. 8). This is partially caused by the fact that cross-track registration may not be initiated until after the first and second peripheral segments 112*a,* 122*a* have released the receiver sheet at time $J_2$. The time $J_2$ at which the first and second segments 112*a,* 122*a* release the receiver sheet is a function of the angular rotation of the drive rollers 112, 122. TABLE 1, shown below, compares exemplary values for time, paper position, and roller rotation during various events in the normal profile (FIG. 8) versus the same events in the first modified profile (FIG. 9). In TABLE 1, "LE" refers to the lead edge of the receiver sheet. The time for each event is shown in milliseconds; the position of the lead edge of the receiver is shown in inches; and the angular rotation of the drive rollers 112, 122 is shown in degrees.

TABLE 1

| | Normal Velocity Profile | | | First Modified Velocity Profile | | |
|---|---|---|---|---|---|---|
| Event | time (ms) | LE position (inches) | roller rotation (deg) | time (ms) | LE position (inches) | roller rotation (deg) |
| Nip sensor detection | 0.0 | 0.000 | 0.0 | 0.0 | 0.000 | 0.0 |
| Begin ramp up | 15.0 | 0.488 | 0.0 | 31.0 | 1.008 | 0.0 |
| $M_1$ and $M_2$ at entrance speed | 37.3 | 1.127 | 26.1 | 53.3 | 1.647 | 26.1 |
| In-track sensor detection | 66.6 | 2.090 | 94.9 | 66.7 | 2.090 | 57.8 |
| Begin ramp-down | 69.1 | 2.173 | 100.9 | 85.2 | 2.697 | 101.1 |
| Skew correction complete | 80.2 | 2.539 | 127.0 | 96.3 | 3.063 | 127.3 |
| Begin ramp-up | 105.2 | 2.539 | 127.0 | 134.9 | 3.063 | 127.3 |
| $M_1$ and $M_2$ at web speed | 117.6 | 2.647 | 134.7 | 147.3 | 3.167 | 134.7 |
| 3rd rollers engage sheet | 127.9 | 2.827 | 147.6 | 157.6 | 3.348 | 147.6 |
| 1st and 2nd rollers release sheet | 144.4 | 3.117 | 168.3 | 174.1 | 3.637 | 168.3 |
| Begin cross-track | 160.9 | 3.405 | 188.9 | 190.6 | 3.925 | 188.9 |
| Cross-track complete | 210.9 | 4.280 | 251.4 | 211.5 | 4.283 | 214.4 |
| Touchdown to web | 227.5 | 4.571 | 272.2 | 227.5 | 4.571 | 235.0 |
| Third rollers | 281.8 | 5.520 | 340.0 | 312.0 | 6.040 | 340.0 |

TABLE 1-continued

| Event | Normal Velocity Profile time (ms) | LE position (inches) | roller rotation (deg) | First Modified Velocity Profile time (ms) | LE position (inches) | roller rotation (deg) |
|---|---|---|---|---|---|---|
| release paper $M_1$ and $M_2$ at home position | 303.0 | 5.892 | 360.0 | 333.2 | 6.412 | 360.0 |

Figure 10:
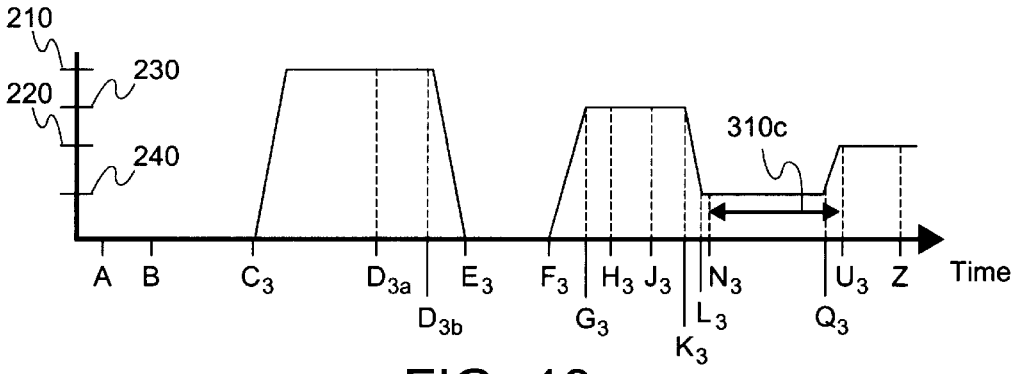
FIG. 10 is a timing diagram of a registration velocity profile for processing long receiver sheets according to another presently preferred embodiment of the invention.

The 20-millisecond period 310*b* of time available for cross-track alignment according to the first modified velocity profile may not be sufficient to allow for correction of a large cross-track misalignment. It is therefore desirable to provide a larger period of time for cross-track alignment when registering long sheets. According to another preferred embodiment of the present invention, a second modified velocity profile for registering 18-inch receiver sheets is provided, which allows for a longer period of time for cross-track alignment. This second modified velocity profile is discussed with reference to FIG. 10.

In this second modified velocity profile, the lead edge of the 18-inch receiver sheet is detected by the nip sensors 160*a,* 160*b* at time B. This time B is the same as the time B in both the normal velocity profile (FIG. 8) and the first modified velocity profile (FIG. 9). As in the first modified profile, the drive rollers 112, 122 are maintained in their home positions for an incremental period of time before ramp-up is initiated at time $C_3$. The incremental period of time may be, for example, approximately 16 milliseconds. Accordingly, the 18-inch sheet, which is being driven by the upstream nips, travels an incremental distance, relative to that traveled according to the normal profile, before it is engaged by the peripheral segments 112*a,* 122*a* of the first and second drive rollers 112, 122. As described above, the incremental distance must be sufficient to allow the upstream nips to release the trailing edge of the 18-inch sheet before the sheet is ramped down for skew correction. For example, the incremental distance may be approximately 0.520 inches. As in the first modified velocity profile, the ramp-down is not initiated immediately after the lead edge of the 18-inch sheet is detected by the in-track sensors 162*a,* 162*b* at time $D_{3a}$. Instead, the ramp-down is initiated at time $D_{3b}$, which occurs an incremental period of time after in-track detection. This incremental period of time is preferably the same as the period of incremental time before ramp-up at time $C_2$. Again, for example, this period of time may be approximately 16 milliseconds. At time $E_3$, the 18-inch sheet is brought to a stop. Any skew in the sheet has been corrected. However, as in the first modified profile, the lead edge of the 18-inch sheet is positioned an incremental distance beyond the predetermined optimal stopping position. Again, for example, this incremental distance may be approximately 0.520 inches.

At time F3, the 18-inch sheet is ramped up to a pre-cross-track speed 230. The pre-cross-track speed 230 is selected to be higher than the web speed 220, but lower than the entrance speed 210. For instance, the pre-cross-track speed 230 may be approximately 21.9 inches/second. The 18-inch sheet is maintained at this relatively high pre-cross-track speed for a period of time sufficient to allow the third peripheral segments 132*a* to engage the sheet at time $H_3$, and to allow the first and second peripheral segments 112*a,* 122*a* to release the sheet at time $J_3$. This accomplishes two things. First, because the first and second peripheral segments 112*a,* 122*a* have released the sheet, the sheet is in the sole control of the third peripheral segments 132*a,* and is ready for cross-track registration. Second, travel at the relatively high pre-cross-track speed causes the sheet to move even further ahead of schedule in terms of downstream position. This essentially gains time for the next phase of this profile, in which the sheet is advanced at a relatively low speed for a period of time during which cross-rack alignment may be performed. Accordingly, at time $K_3$, the receiver sheet is ramped down to a low speed 240. This low speed 240 is preferably chosen to be somewhat lower than web speed. For instance, this speed 240 may be approximately 8.75 inches/second. Shortly after achieving this low speed 240 at time $L_3$, cross-track registration begins at time $N_3$. Cross-track registration is completed before time $U_3$. At time $Q_3$, before the end of the period 310*c* of time during which cross-track registration is performed, the receiver sheet is ramped up to web speed 220. After achieving web speed 220, the 18-inch sheet touches down on the moving web W at the proper time Z.

Because the 18-inch sheet travels at a relatively low speed 240 during most of the cross-track registration period 310*c,* this period 310*c* can be longer than the period 310*b* of time allowed for cross-track registration according to the first modified velocity profile (FIG. 9). For example, the period 310*c* of time available for cross-track alignment according to this second modified velocity profile may be approximately 40 milliseconds. This allows for a wider range of cross-track alignment than is available in the first modified velocity profile.

TABLE 2, shown below, lists exemplary values for time, paper position, and roller rotation during various events according to the second modified velocity profile. In TABLE 2, "LE" refers to the lead edge of the receiver sheet. The time for each event is shown in milliseconds; the position of the lead edge of the receiver is shown in inches; and the angular rotation of the drive rollers 112, 122 is shown in degrees.

TABLE 2

| Event | Second Modified Velocity Profile time (ms) | LE position (inches) | roller rotation (deg) |
|---|---|---|---|
| Nip sensor detection | 0.0 | 0.000 | 0.0 |
| Begin ramp up | 31.0 | 1.008 | 0.0 |
| $M_1$ and $M_2$ at entrance speed | 53.3 | 1.647 | 26.1 |
| In-track sensor detection | 66.7 | 2.090 | 57.8 |
| Begin ramp-down | 85.2 | 2.697 | 101.1 |
| Skew correction complete | 96.3 | 3.063 | 127.3 |
| Begin ramp-up | 121.3 | 3.063 | 127.3 |
| $M_1$ and $M_2$ at pre-cross-track speed | 133.7 | 3.198 | 136.9 |
| 3rd rollers engage sheet | 140.5 | 3.347 | 147.6 |
| 1st and 2nd rollers release sheet | 153.8 | 3.637 | 168.3 |
| Begin ramp-down to low speed | 163.7 | 3.855 | 183.8 |
| $M_1$ and $M_2$ at low speed | 169.0 | 3.936 | 187.7 |
| Begin cross-track | 170.9 | 3.925 | 188.9 |
| Begin ramp-up to web speed | 205.1 | 4.252 | 210.3 |

TABLE 2-continued

| Event | Second Modified Velocity Profile time (ms) | LE position (inches) | roller rotation (deg) |
|---|---|---|---|
| $M_1$ and $M_2$ at web speed | 211.3 | 4.306 | 214.1 |
| Cross-track complete | 211.5 | 4.283 | 214.4 |
| Touchdown to web | 228.0 | 4.571 | 235.0 |
| Third rollers release paper | 312.0 | 6.040 | 340.0 |
| $M_1$ and $M_2$ at home position | 333.2 | 6.412 | 360.0 |

Due to slight variation in system movement, and the tolerances associated therewith, there is preferably provided a buffer of time on either end of the cross-track registration period. For instance the time between time $J_1$ and $N_1$ may be approximately 16 milliseconds. Likewise, the buffer time between times $U_1$ and Z may be approximately 16 milliseconds. Similar buffers are preferably maintained between times $J_2$ and $N_2$, and times $U_2$ and Z of the first modified velocity profile, as well as time $J_3$ and $N_3$, and times $U_3$ and Z of the second modified velocity profile. These buffers place further limitations on the periods 310*a–c* of time available for cross-track alignment in the various velocity profiles.

Although specific embodiments are described as facilitating registration of 18-inch sheets in a registration system optimized for 17-inch sheets, the invention contemplates other lengths as well. For example, various embodiments of the invention allow for registering longer-than-optimal sheets in the following circumstances: registering letter-sized paper (8.5-inches) in a system optimized for A4-sized paper (8.27-inches); registering tabbed letter-sized paper (9.0-inches) in a system optimized for regular letter sized-paper (8.5-inches); registering JIS-B4-sized paper (10.12-inches) in a system designed for tabbed letter-sized paper (9.0-inches); and registering JIS-B4-sized paper lengthwise (14.34 inches) in a system optimized for legal-sized paper lengthwise (14-inches). Additional embodiments of the invention would apply equal well to other circumstances in which registration of longer-than-optimal sheets is desired.

Moreover, although the invention is described with specific reference to electrophotographic apparatus and methods, the invention has broader applicability to other fields wherein registration of a moving sheet is to be made with an image-bearing member.

The invention has been described in detail with particular reference to preferred embodiments thereof and illustrative examples, but it will be understood that variations and modifications can be effected within the spirit and scope of the invention.

What is claimed is:

1. An apparatus for moving a receiver having a lead edge and a trailing edge from an upstream nip into a registered relationship with an image-bearing member moving at an image-bearing member speed, the apparatus comprising:

a motor;

a drive member operable to engage the receiver;

a drive coupling connecting the motor with the drive member; and a controller operable to drive the motor in accordance with a first velocity profile if the receiver is of a predetermined optimal receiver length, and to drive the motor in accordance with a second velocity profile if the receiver is longer than the predetermined optimal receiver length.

2. An apparatus for moving a receiver as in claim 1, wherein:

the predetermined optimal receiver length is approximately 17 inches; and the receiver has a length of approximately 18 inches.

3. An apparatus for moving a receiver having a lead edge and a trailing edge from an upstream nip into a registered relationship with an image-bearing member moving at an image-bearing member speed, the apparatus comprising:

a motor;

a drive member operable to engage the receiver;

a drive coupling connecting the motor with the drive member; and a controller operable to drive the motor in a first mode if the receiver is of a predetermined optimal receiver length, and to drive the motor in a second mode if the receiver is longer than the predetermined optimal receiver length;

wherein the controller drives the motor in the first mode to stop the receiver at a predetermined optimal stopping position; and wherein the controller drives the motor in the second mode to stop the receiver an incremental distance beyond the predetermined optimal stopping position.

4. An apparatus for moving a receiver as in claim 3, wherein:

the predetermined optimal receiver length is approximately 17 inches; and the receiver has a length of approximately 18 inches.

5. An apparatus for moving a receiver as in claim 4, wherein:

the incremental distance is approximately 0.520 inches.

6. An apparatus for moving a receiver having a lead edge and a trailing edge from an upstream nip into a registered relationship with an image-bearing member moving at an image-bearing member speed, the apparatus comprising:

a motor;

a drive member operable to engage the receiver;

a drive coupling connecting the motor with the drive member; and a controller operable to drive the motor in a first mode if the receiver is of a predetermined optimal receiver length, and to drive the motor in a second mode if the receiver is longer than the predetermined optimal receiver length;

wherein the controller drives the motor in accordance with a first velocity profile in the first mode to stop the receiver at a predetermined optimal stopping position; and wherein the controller drives the motor in accordance with a second velocity profile in the second mode to stop the receiver an incremental distance beyond the predetermined optimal stopping position.

7. An apparatus for moving a receiver having a lead edge, a trailing edge, and a length of more than a predetermined optimal receiver length, from an upstream nip into a registered relationship with an image-bearing member moving at an image-bearing member speed, the apparatus comprising:

a motor;

a drive member operable to engage the receiver;

a drive coupling connecting the motor with the drive member;

a sensor operable to detect the lead edge of the receiver; and a controller operable to drive the motor to (1) move the drive member into engagement with the receiver when the lead edge of the receiver has moved an incremental distance beyond the sensor, the incremental distance being sufficiently large that the trailing edge of the receiver is released from the nip, (2) stop the receiver for a period of time, and (3) deliver the receiver to the image-bearing member at a proper time and at a speed substantially equal to the image-bearing member speed.

8. An apparatus for moving a receiver having a lead edge, a trailing edge, and a length of more than a predetermined optimal receiver length, from an upstream nip into a registered relationship with a moving image-bearing member moving at an image-bearing member speed, the apparatus comprising:

a motor;

a drive member operable to engage the receiver;

a drive coupling connecting the motor with the drive member;

a sensor operable to detect the lead edge of the receiver; and a controller operable to drive the motor to (1) move the drive member into engagement with the receiver when the lead edge of the receiver has moved an incremental distance beyond the sensor, the incremental distance being sufficiently large that the trailing edge of the receiver is released from the nip, (2) stop the receiver, (3) accelerate the receiver to a speed higher than the image-bearing member speed; (4) decelerate the receiver to a speed lower than the image-bearing member speed for a period of time sufficient to complete a cross-track registration; and (5) deliver the receiver to the image-bearing member at a proper time and at a speed substantially equal to the image-bearing member speed.

9. An apparatus for moving a receiver having a lead edge, a trailing edge, and a length of more than a predetermined optimal receiver length, from an upstream nip into a registered relationship with an image-bearing member moving at an image-bearing member speed, the apparatus comprising:

a motor;

a roller assembly operable to engage the receiver, the roller assembly having a home position in which the roller assembly does not engage the receiver;

a drive coupling connecting the motor with the roller assembly;

a sensor operable to detect the lead edge of the receiver; and a controller operable to drive the motor to (1) maintain the roller assembly in the home position for an incremental period of time sufficiently large that the trailing edge of the receiver is released from the nip, (2) stop the receiver for a period of time, and (3) deliver the receiver to the image-bearing member at a proper time and at a speed substantially equal to the image-bearing member speed.

10. An apparatus for moving a receiver as in claim 9, wherein:

the predetermined optimal receiver length is approximately 17 inches; and the receiver has a length of approximately 18 inches.

11. An apparatus for moving a receiver as in claim 10, wherein:

the incremental period of time is approximately 16 milliseconds.

12. An apparatus for moving a receiver having a lead edge, a trailing edge, and a length of more than a predetermined optimal receiver length, from an upstream nip into a registered relationship with an image-bearing member moving at an image-bearing member speed, the apparatus comprising:

a motor;

a roller assembly operable to engage the receiver, the roller assembly having a home position in which the roller assembly does not engage the receiver;

a drive coupling connecting the motor and the roller assembly;

a sensor operable to detect the lead edge of the receiver; and a controller operable to drive the motor to (1) maintain the roller assembly in the home position for a first period of time sufficiently large that the trailing edge of the receiver is released from the nip, (2) stop the receiver, (3) accelerate the receiver to a speed higher than the image-bearing member speed; (4) decelerate the receiver to a speed lower than the image-bearing member speed for a second period of time sufficient to complete a cross-track registration; and (5) deliver the receiver to the image-bearing member at a proper time and at a speed substantially equal to the image-bearing member speed.

13. A method of moving a receiver having a lead edge and a trailing edge from an upstream engaging nip into a registered relationship with a moving image-bearing member moving at an image-bearing member speed, the method comprising the steps of:

providing a motor, a drive member operable to engage the receiver, and a drive coupling connecting the motor with the drive member;

providing a controller operable to drive the motor;

operating the controller in accordance with a first velocity profile if the receiver is of a predetermined optimal receiver length; and operating the controller in accordance with a second velocity profile if the receiver is longer than the predetermined optimal receiver length.

14. A method of moving a receiver as in claim 13, wherein:

the predetermined optimal receiver length is approximately 17 inches; and the receiver has a length of approximately 18 inches.

15. A method of moving a receiver having a lead edge and a trailing edge from an upstream engaging nip into a registered relationship with a moving image-bearing member moving at an image-bearing member speed, the method comprising the steps of:

providing a motor, a drive member operable to engage the receiver, and a drive coupling connecting the motor with the drive member;

providing a controller operable to drive the motor;

operating the controller in a first mode if the receiver is of a predetermined optimal receiver length; and operating the controller in a second mode if the receive is longer than the predetermined optimal receiver length;

wherein the controller is operated in the first mode to stop the receiver at a predetermined position; and wherein the controller is operated in the second mode to stop the receiver an incremental distance beyond the predetermined position.

16. A method of moving a receiver as in claim 15, wherein:

the predetermined optimal receiver length is approximately 17 inches; and the receiver has a length of approximately 18 inches.

17. A method of moving a receiver as in claim 16, wherein:

the incremental distance is approximately 0.520 inches.

18. A method of moving a receiver having a lead edge and a trailing edge from an upstream engaging nip into a registered relationship with a moving image-bearing member moving at an image-bearing member speed, the method comprising the steps of:

providing a motor, a drive member operable to engage the receiver, and a drive coupling connecting the motor with the drive member;

providing a controller operable to drive the motor;

operating the controller in a first mode if the receiver is of a predetermined optimal receiver length; and operating the controller in a second mode if the receive is longer than the predetermined optimal receiver length;

wherein the controller is operated in accordance with a first velocity profile in the first mode to stop the receiver at a predetermined position; and wherein the controller is operated in accordance with a second velocity profile in the second mode to stop the receiver an incremental distance beyond the predetermined position.

19. A method of moving a receiver having a lead edge, a trailing edge, and a length of more than a predetermined optimal receiver length, from an upstream engaging nip into a registered relationship with a moving image-bearing member moving at an image-bearing member speed, the method comprising the steps of:

detecting the lead edge of the receiver with a sensor;

moving a drive member into engagement with the receiver when the lead edge of the receiver has moved an incremental distance beyond the sensor, the incremental distance being sufficiently large that the trailing edge of the receiver is released from the nip before the receiver is brought to a stop;

stopping the receiver; and delivering the receiver to the image-bearing member at a proper time and at a speed substantially equal to the image-bearing member speed.

20. A method of moving a receiver as in claim 19, further comprising the steps of:

accelerating the receiver to a speed higher than image-bearing member speed after stopping the receiver; and decelerating the receiver to a speed lower than image-bearing member speed for a period of time sufficient to complete a cross-track registration before delivering the receiver to the image-bearing member.

21. A method of moving a receiver as in claim 19, wherein:

the predetermined optimal receiver length is approximately 17 inches; and the receiver has a length of approximately 18 inches.

22. A method of moving a receiver as in claim 21, wherein:

the incremental distance is approximately 0.520 inches.

23. A method of using a drive assembly operable to engage a receiver to move the receiver from an upstream engaging nip into a registered relationship with a moving image-bearing member moving at an image-bearing member speed, the drive assembly having a home position in which the drive assembly does not engage the receiver, and the receiver having a lead edge, a trailing edge, and a length of more than a predetermined optimal receiver length, the method comprising the steps of:

detecting the lead edge of the receiver with a sensor;

maintaining the drive assembly in the home position for an incremental period of time sufficient to allow the trailing edge of the receiver to be released from the nip before the receiver is brought to a stop;

moving the drive assembly into engagement with the receiver;

stopping the receiver; and delivering the receiver to the image-bearing member at a proper time and at a speed substantially equal to the image-bearing member speed.

24. A method of using a drive assembly to move a receiver as in claim 23, wherein:

the predetermined optimal receiver length is approximately 17 inches; and the receiver has a length of approximately 18 inches.

25. A method of using a drive assembly to move a receiver as in claim 24, wherein:

the incremental period of time is approximately 16 milliseconds.

* * * * *